US009615413B2

(12) United States Patent
Raval et al.

(10) Patent No.: US 9,615,413 B2
(45) Date of Patent: Apr. 4, 2017

(54) DRIVER CIRCUIT USING DYNAMIC REGULATION AND RELATED TECHNIQUES

(71) Applicant: Allegro Microsystems, LLC, Worcester, MA (US)

(72) Inventors: Pranav Raval, Nashua, NH (US); Bassem Alnahas, Manchester, NH (US); Nai-Chi Lee, Nashua, NH (US)

(73) Assignee: Allegro Microsystems, LLC, Worcester, MA (US)

( * ) Notice: Subject to any disclaimer, the term of this patent is extended or adjusted under 35 U.S.C. 154(b) by 585 days.

(21) Appl. No.: 14/013,306

(22) Filed: Aug. 29, 2013

(65) Prior Publication Data

US 2015/0061528 A1 Mar. 5, 2015

(51) Int. Cl.
*H05B 33/08* (2006.01)
*H05B 37/02* (2006.01)

(52) U.S. Cl.
CPC ..... *H05B 33/0815* (2013.01); *H05B 33/0827* (2013.01)

(58) Field of Classification Search
None
See application file for complete search history.

(56) References Cited

U.S. PATENT DOCUMENTS 6,982,527 B2 1/2006 Lee et al.
7,675,245 B2 3/2010 Szczeszynski et al.
7,999,487 B2 8/2011 Szczeszynski
8,169,161 B2 5/2012 Szczeszynski et al.
8,274,238 B2 9/2012 Szczeszynski et al.
8,339,049 B2 12/2012 Kang et al.
8,456,105 B2 6/2013 Wang et al.
8,482,225 B2 7/2013 Szczeszynski
8,519,630 B2 8/2013 Wang et al.
8,664,930 B2 3/2014 Kang et al.
8,742,682 B1 6/2014 Wang et al.
8,901,835 B2 12/2014 Kang et al.
8,937,433 B1 1/2015 Wang et al.
8,957,607 B2 2/2015 Raval et al.
(Continued)

FOREIGN PATENT DOCUMENTS

WO WO 2008/086050 A2 7/2008
WO WO 2008/086050 A3 7/2008
WO WO 2009/064682 A2 5/2009
WO WO 2009/064682 A3 5/2009
WO WO 2012/082365 A1 6/2012
(Continued)

OTHER PUBLICATIONS

A8500 Data Sheet; "Flexible WLED/RGB Backlight Driver for Medium Size LCDs;" Allegro MicroSystems; 16 pages.
(Continued)

*Primary Examiner* — Dedei K Hammond
(74) *Attorney, Agent, or Firm* — Daly, Crowley, Mofford & Durkee, LLP

(57) ABSTRACT

An LED driver circuit selects a regulated voltage value for use in driving one or more LEDs based on dimming duty cycle. In some embodiments, the regulated voltage value may be selected in accordance with a function that decreases monotonically with increasing dimming duty cycle. In this manner, LED current accuracy can be achieved at lower dimming duty cycles, while still achieving enhanced operational efficiency at higher dimming duty cycles.

27 Claims, 9 Drawing Sheets

(56) References Cited

U.S. PATENT DOCUMENTS

| | | | | |
|---|---|---|---|---|
| 8,994,279 | B2 | 3/2015 | Raval et al. | |
| 9,144,126 | B2 | 9/2015 | Raval et al. | |
| 2012/0146541 | A1 | 6/2012 | Szczeszynski et al. | |
| 2012/0181939 | A1 | 7/2012 | Szczeszynski et al. | |
| 2013/0009556 | A1 | 1/2013 | Szczeszynski et al. | |
| 2013/0009557 | A1 | 1/2013 | Szczeszynski | |
| 2013/0026951 | A1* | 1/2013 | Li | H05B 33/0848 315/307 |
| 2013/0162152 | A1 | 6/2013 | Lee et al. | |
| 2014/0292220 | A1 | 10/2014 | Trattler | |
| 2015/0216009 | A1 | 7/2015 | Lee et al. | |

FOREIGN PATENT DOCUMENTS

| | | | |
|---|---|---|---|
| WO | WO 2012/148632 | A1 | 11/2012 |
| WO | WO 2013/006272 | A1 | 1/2013 |
| WO | WO 2013/006304 | A1 | 1/2013 |
| WO | WO 2013/095769 | A1 | 6/2013 |
| WO | WO 2014/031300 | A1 | 2/2014 |
| WO | WO 2014/031301 | A1 | 2/2014 |
| WO | WO 2014/031301 | A8 | 2/2014 |

OTHER PUBLICATIONS

A8501 Data Sheet; "2 MHz, 4 Channel X 100 mA WELD/RGB Driver with Output Disconnect;" Allegro MicroSystems; 24 pages.

A8502 Data Sheet; "Wide Input Voltage Range, High Efficiency Fault Tolerant LED Driver," Allegro MicroSystems; 35 pages.

A8503 Data Sheet; "High Efficiency 6-Channel, 2 MHz, WLED/RGB Driver for Medium Displays, with Integrated 55 V Power Switch" Allegro MicroSystems; 17 pages.

A8504 Data Sheet; "WLED/RGB Backlight Driver for Medium Size LCDs;" Allegro MicroSystems; 18 pages.

A8507 Data Sheet; "LED Backlight Driver for LCD Monitors and Televisions;" Allegro MicroSystems; 16 pages.

A8508 Data Sheet; "Wide Input Voltage Range, High Efficiency 8-Channel Fault Tolerant LED Driver;" Allegro MicroSystems; 28 pages.

A8507 Data Sheet; "Wide Input Voltage, Fault Tolerant, Independently Controlled Multi-Channel LED Driver with $I^2C$ interface;" Allegro MicroSystems; 62 pages.

MAX16838; Integrated, 2-Channel, High-Brightness LED Driver with High-Voltage Boost and SEPIC Controller; MAXIM; 19-4972; Rev 2; Apr. 2011; 21 pages.

MP3394; MPS; Step-up, 4-String Max 200mA/String White LED Driver; Rev. 1.07; Mar. 21, 2013; 17 pages.

Response to U.S. Office Action dated Nov. 30, 2016 corresponding to U.S. Appl. No. 15/175,117; Response filed on Dec. 22, 2016; 8 Pages.

Office Action dated Nov. 30 2016 from U.S. Appl. No. 15/175,117; 14 Pages.

* cited by examiner

DRIVER CIRCUIT USING DYNAMIC REGULATION AND RELATED TECHNIQUES

FIELD

Subject matter disclosed herein relates generally to electronic circuits and, more particularly, to driver circuits for use in driving light emitting diodes (LEDs) and/or other loads.

BACKGROUND

Light emitting diode (LED) driver circuits are circuits that are used to drive one or more LEDs, typically in a controlled manner. In some instances, LED driver circuits are configured to drive multiple series-connected strings of diodes, known as "LED channels," but driver circuits that drive single channels, or single diodes, also exist. When driving multiple LED channels, the channels may be operated in parallel with a common voltage node supplying all of the channels. A DC-DC converter (e.g., a boost converter, a buck converter, etc.) may be employed by the LED driver circuit for use in regulating a voltage level associated with the driven LEDs to ensure that all LEDs have adequate operational power. Feedback from the LEDs may be used to control the DC-DC converter. To reduce unnecessary power consumption, the regulated voltage level maintained by the DC-DC converter may be kept to a minimum or near minimum, while still providing adequate power to all LEDs.

During LED driver operation, it may be desirable to vary the light intensity of some or all of the LEDs. One technique for doing this involves driving the LEDs at a variable duty cycle (known as the dimming duty cycle). When a higher duty cycle is applied to the LEDs, a higher light intensity is typically generated. Likewise, when a lower duty cycle is applied to the LEDs, a lower light intensity is generated. Problems may occur, however, when attempting to drive LEDs at dimming duty cycles that are very low. For example, in some systems, a controller associated with a DC-DC converter may be unable to accurately track feedback levels when a dimming duty cycle is too low becalm the LEDs will be "off" for a relatively long time.

In addition, in some cases, a "turn on" time of the LEDs may limit the ability of a driver to support low dimming duty cycles. An LED driver circuit will typically take a finite amount of time to reach a desired LED current level once a drive signal is applied. Any "feedback" provided to the DC-DC converter controller during this "turn on" time can be error prone as the corresponding signal values are in a state of transition. For this reason, feedback blanking is often used to blank out portions of the feedback signal that occur during the "turn on" time. If the "turn on" time of the driver is comparable in duration to then time of the dimming duty cycle (i.e., the time period during which the corresponding LEDs are to be energized), then the DC-DC converter may not have adequate time to properly regulate the target voltage using the available feedback (i.e., the available portion of the feedback signal is not long enough to allow the target voltage to adapt).

Techniques and circuits are needed for improving the ability of LED drivers to operate under short dimming duty cycles.

SUMMARY

In accordance with one aspect of the concepts, systems, circuits, and techniques described herein, a method for use in driving one or more LED loads, comprises: regulating a voltage associated with at least one LED load; and varying a regulated voltage value used during regulating based, at least in part, on a present dimming duty cycle associated with the at least one LED load.

In one embodiment, varying a regulated voltage value includes varying the regulated voltage value according to a function that decreases monotonically with increasing dimming duty cycle.

In one embodiment, varying a regulated voltage value comprises using a fixed regulated voltage value if the present dimming duty cycle of the at least one LED load is above a first threshold value and using a variable regulated voltage value that is greater than the fixed regulated voltage value if the present dimming duty cycle of the at least one LED load is below the first threshold value.

In one embodiment, the first threshold value corresponds to a dimming duty cycle between 5 percent and 20 percent.

In one embodiment, varying a regulated voltage value comprises using a first fixed regulated voltage value if the present dimming duty cycle of the at least one LED load is above a first threshold value and using a second fixed regulated voltage value if the present dimming duty cycle of the at least one LED load is below a second threshold value.

In one embodiment, varying a regulated voltage value comprises using a variable regulated voltage value that varies between the first fixed regulated voltage value and the second fixed regulated voltage value if the present dimming duty cycle of the at least one LED load is between the first threshold value and the second threshold value.

In one embodiment, the at least one LED load includes an LED channel that is coupled to a current regulation device to regulate a current flowing through the LED channel; and regulating a voltage associated with at least one LED load includes regulating a voltage across the current regulation device; wherein varying a regulated voltage value used during regulating includes varying the regulated voltage value in a manner that improves LED current accuracy for low dimming duty cycles.

In accordance with another aspect of the concepts, systems, circuits, and techniques described herein, a method for use in driving one or more light emitting diodes (LEDs) using a DC-DC converter comprises: determining a dimming duty cycle for at least one LED; determining a regulated voltage value to be used in connection with the at least one LED based, at least in part, on the dimming duty cycle; and generating a control signal for the DC-DC converter based on the regulated voltage value and feedback associated with the at least one LED.

In one embodiment, determining a dimming duty cycle includes extracting the dimming duty cycle from a pulse width modulation (PWM) control signal associated with the at least one LED.

In one embodiment, determining a regulated voltage value includes determining a regulated voltage value to appear across a current regulation device associated with the at least one LED.

In one embodiment, the one or more LEDs includes multiple parallel LED channels that are each coupled to a corresponding current regulation device, wherein determining a regulated voltage value includes determining a regulated voltage value to appear across a current regulation device associated with one of the multiple LED channels.

In one embodiment, determining a dimming duty cycle includes determining a dimming duty cycle to be used in all of the multiple parallel LED channels that are presently enabled.

In one embodiment, determining a regulated voltage value to appear across a current regulation device associated with one of the multiple LED channels includes determining a regulated voltage value to appear across a current regulation device associated with a dominant channel.

In one embodiment, the one or more LEDs includes multiple parallel LED channels that are each coupled to a corresponding current regulation device, wherein determining a regulated voltage value includes determining an average voltage value to appear across the current regulation devices associated with the multiple LED channels.

In one embodiment, determining a regulated voltage value includes determining a value in accordance with a function that decreases monotonically with increasing dimming duty cycle.

In one embodiment, the function is adapted to achieve enhanced operational efficiency for higher dimming duty cycles and enhanced LED current accuracy for lower dimming duty cycles.

In one embodiment, determining a regulated voltage value includes determining the regulated voltage value by evaluating an equation.

In one embodiment, determining a regulated voltage value includes determining the regulated voltage value using a lookup table (LUT).

In one embodiment, determining a regulated voltage value includes using a first voltage value if the dimming duty cycle is above a first threshold level and using a variable voltage value that is higher than the first voltage value if the dimming duty cycle is below the first threshold level.

In one embodiment, determining a regulated voltage value includes: using a first voltage value if the dimming duty cycle is above a first threshold level; using a second voltage value if the dimming duty cycle is below a second threshold level, wherein the second voltage value is greater than the first voltage value; and using a variable voltage value that varies between the first and second voltage values if the dimming duty cycle is between the first and second threshold levels.

In one embodiment, the method further comprises: continually repeating determining a dimming duty cycle, determining a regulated voltage value, and generating a control signal while driving the one or more light emitting diodes (LEDs).

In accordance with a further aspect of the concepts, systems, circuits, and techniques described herein, a light emitting diode (LED) driver circuit to drive one or more LEDs using a DC-DC converter comprises: dimming control circuitry to set a dimming duty cycle of at least one LED, wherein the dimming control circuitry is capable of changing the dimming duty cycle of the at least one LED over time; regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED.

In one embodiment, the dimming control circuitry is configured to generate a pulse width modulation (PWM) control signal for use with the at least one LED based on the dimming duty cycle; and the regulated voltage determination circuitry includes a duty cycle extractor to receive the PWM control signal and to extract the dimming duty cycle therefrom for use in determining the regulated voltage value.

In one embodiment, the regulated voltage determination circuitry is implemented primarily in analog circuitry.

In one embodiment, the regulated voltage determination circuitry is implemented primarily in digital circuitry.

In one embodiment, the regulated voltage determination circuitry is configured to determine the regulated voltage value in accordance with a function that decreases monotonically with increasing dimming duty cycle.

In one embodiment, the regulated voltage determination circuitry is configured to output a fixed regulated voltage value if the dimming duty cycle is above a first threshold value and to output a variable regulated voltage value that is greater than the fixed regulated voltage value if the dimming duty cycle is below the first threshold value.

In one embodiment, the first threshold value corresponds to a dimming duty cycle between 5 and 20 percent.

In one embodiment, the regulated voltage determination circuitry is configured to output a first fixed regulated voltage value if the dimming duty cycle is above a first threshold value, to output a second fixed regulated voltage value if the dimming duty cycle is below a second threshold value, and to output a variable regulated voltage value that varies between the first fixed regulated voltage value and the second fixed regulated voltage value if the dimming duty cycle is between the first threshold value and the second threshold value.

In one embodiment, the regulated voltage determination circuitry includes a lookup table for use in determining a regulated voltage value based on the dimming duty cycle.

In one embodiment, the at least one LED includes multiple LEDs arranged in a number of LED channels; and the LED driver circuit includes a current regulation device for each of the LED channels; wherein the regulated voltage determination circuitry is configured to determine a regulated voltage value to appear across the current regulation device associated with a dominant LED channel.

In one embodiment, the LED driver circuit is implemented as an integrated circuit having at least one contact for connection to an external DC-DC converter.

In one embodiment, the one or more LEDs includes multiple LEDS arranged in a number of LED channels; the dimming control circuitry is capable of generating different pulse width modulation (PWM) control signals for use in switching different LED channels in accordance with different dimming duty cycles; and the regulated voltage determination circuitry includes multiple duty cycle extractors to extract dimming duty cycles from different PWM control signals.

In one embodiment, the LED driver circuit is capable of driving multiple LEDs at variable load current and over a wide dimming range while generating little or no audible noise.

BRIEF DESCRIPTION OF THE DRAWINGS

The foregoing features may be more fully understood from the following description of the drawings in which.

DETAILED DESCRIPTION

Figure 1:
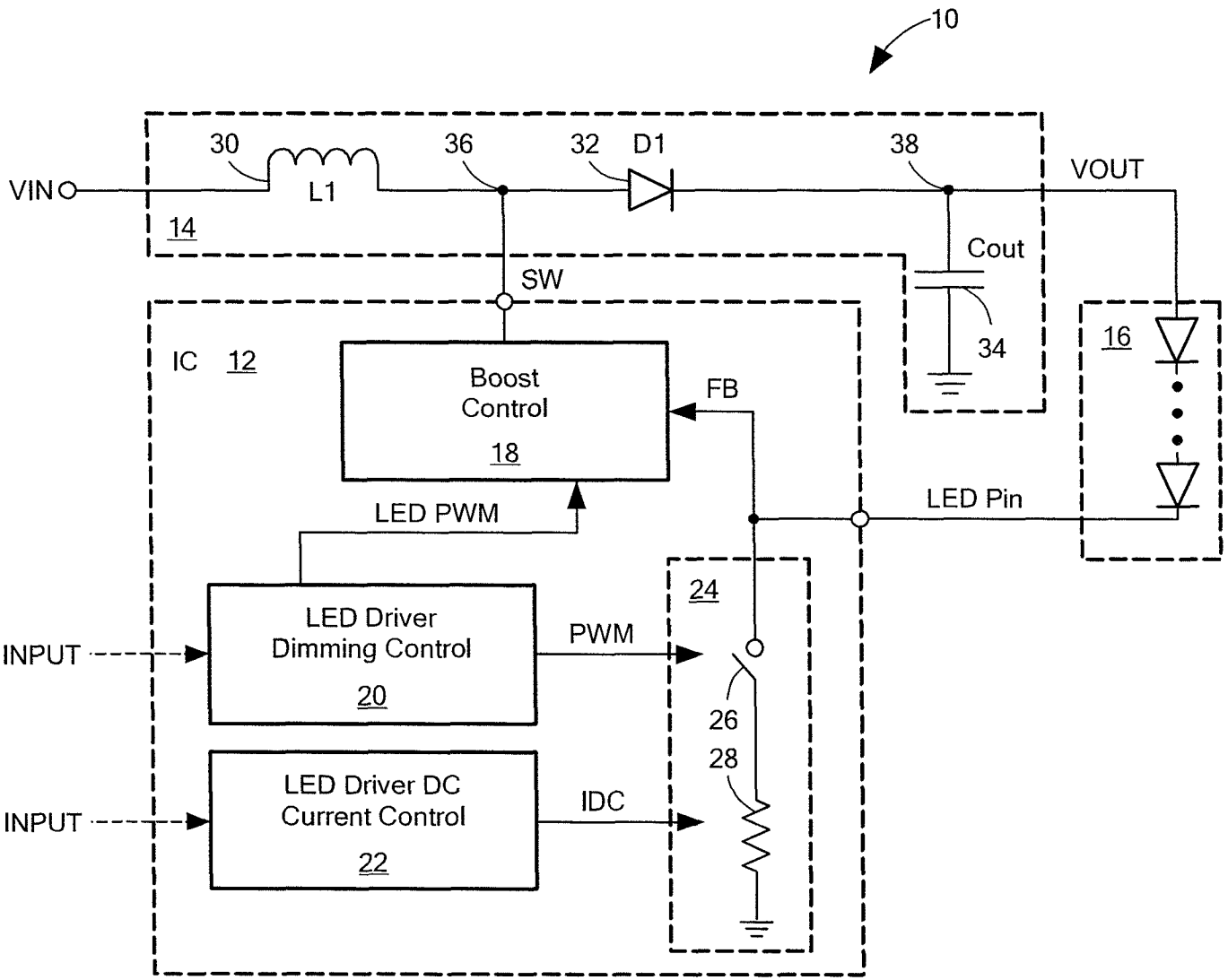
FIG. 1 is a schematic diagram illustrating a light emitting diode (LED) driver system that may incorporate features or techniques described herein.

FIG. 1 is a schematic diagram illustrating an exemplary light emitting diode (LED) driver system 10 that may incorporate features or techniques described herein. As shown, LED driver system 10 may include LED driver circuitry 12 and a boost converter 14. During operation, an output of the driver system 10 may be coupled to one or more LEDs 16 to drive the LEDs in a controlled fashion. In the illustrated arrangement, multiple LEDs 16 are connected in series in a single string. In other configurations, the driver system 10 may drive a single LED, multiple parallel-connected LEDs, multiple strings of LEDs connected in parallel, or some combination of the above. Boost converter 14 is a DC-DC voltage converter that is used to convert a direct current (DC) input voltage $V_{IN}$ to a DC output voltage $V_{OUT}$ on an output node 38 for use in driving the LEDs 16. As is well known, a boost converter is a form of switching regulator that utilizes switching techniques and energy storage elements to generate a desired output voltage. Other types of DC-DC converters may alternatively be used.

In the arrangement shown in FIG. 1, the LED driver circuitry 12 is implemented as an integrated circuit (IC) and the boost converter 14 is implemented outside the IC using discrete components. It should be appreciated, however, that many alternative arrangements are possible including fully integrated implementations, fully discrete implementations, or some other combination of integrated and discrete components.

As shown in FIG. 1, the LED driver circuitry 12 may include boost control circuitry 18 for use in controlling the operation of boost converter 14. In general, the boost converter 14 and the boost controller 18 will operate together to regulate a voltage associated with the LED(s) 16. The LED driver circuitry 12 may also include LED driver dimming control circuitry 20, LED driver DC current control circuitry 22, and a current sink 24. The current sink 24 is coupled to the LED(s) 16 and may be used to, for example, adjust a dimming duty cycle of the LED(s) 16 and/or a DC current level of the LED(s) 16. The LED driver dimming control circuitry 20 and the LED driver DC current control circuitry 22 may be used to control the current sink 24 to set the corresponding values. As shown, the current sink 24 may include a switch 26 and a variable resistance 28. The LED driver dimming control circuitry 20 may control the dimming duty cycle of the LED(s) 16 by, for example, causing switch 26 to be opened and closed in an appropriate manner. The LED driver dimming control circuitry 20 may, for example, generate a pulse width modulation (PWM) signal for delivery to the switch 26 to generate the desired dimming duty cycle. The LED driver DC current control circuitry 22 may set a DC current flowing through the LED(s) 16 during dimming "on" periods by, for example, adjusting a resistance associated with the variable resistance 28. In some implementations, a transistor "current sink" device may be used to provide the functions of both the switch 26 and the variable resistance 28.

As described above, the boost converter 14 is operative for converting a DC input voltage $V_{IN}$ to a DC output voltage $V_{OUT}$ that is adequate to supply the LED(s) 16. The operating principles of boost converters and other types of DC-DC converters are well known in the art. During operation, the boost control circuitry 18 provides a switching signal to a switching node 36 (SW) of the boost converter 14. The switching signal draws current from the switching node 36 at a controlled duty cycle to regulate a voltage associated with the LED(s) 16 in a closed loop manner. It should be understood that the duty cycle used to control the boost converter 14 is a different parameter from the dimming duty cycle used to adjust the illumination intensity of the LED(s) 16. In the illustrated embodiment, the boost converter 14 includes an inductor 30, a diode 32, and a capacitor 34 coupled together in a specific configuration. Other boost converter architectures may alternatively be used.

To control the duty cycle of the boost converter 14, the boost control circuitry 18 uses feedback from the LED(s) 16. As shown in FIG. 1, the voltage across the current sink 24 associated with the LED(s) 16 (which is also the LED pin voltage of the associated IC) may be used as the feedback. In general, the voltage across the current sink 24 will have to be above a certain minimum value to enable the current sink 24 to accurately set the desired current through the LED(s) 16. If the voltage level across the current sink 24 fails below this minimum value, the current accuracy will degrade. A minimum (or near minimum) voltage level may be specified for the current sink 24 that will result in reliable operation. This minimum voltage may be referred to as the "LED regulation voltage." The boost control circuitry 18 may be configured to control the boost converter 14 in a manner that ensures that the output voltage of the boost 14 is high enough to maintain at least this minimum voltage level across the current sink 24 during the "on" portion of the LED dimming cycle. To conserve energy, however, it may be desired that the regulated voltage level be no higher (or only slightly higher) than the minimum level required to support operation. The voltage level across current sink 24 will be equal to the difference between the boost output voltage on voltage node 38 and the voltage drop across the LED(s) 16.

Figure 2:
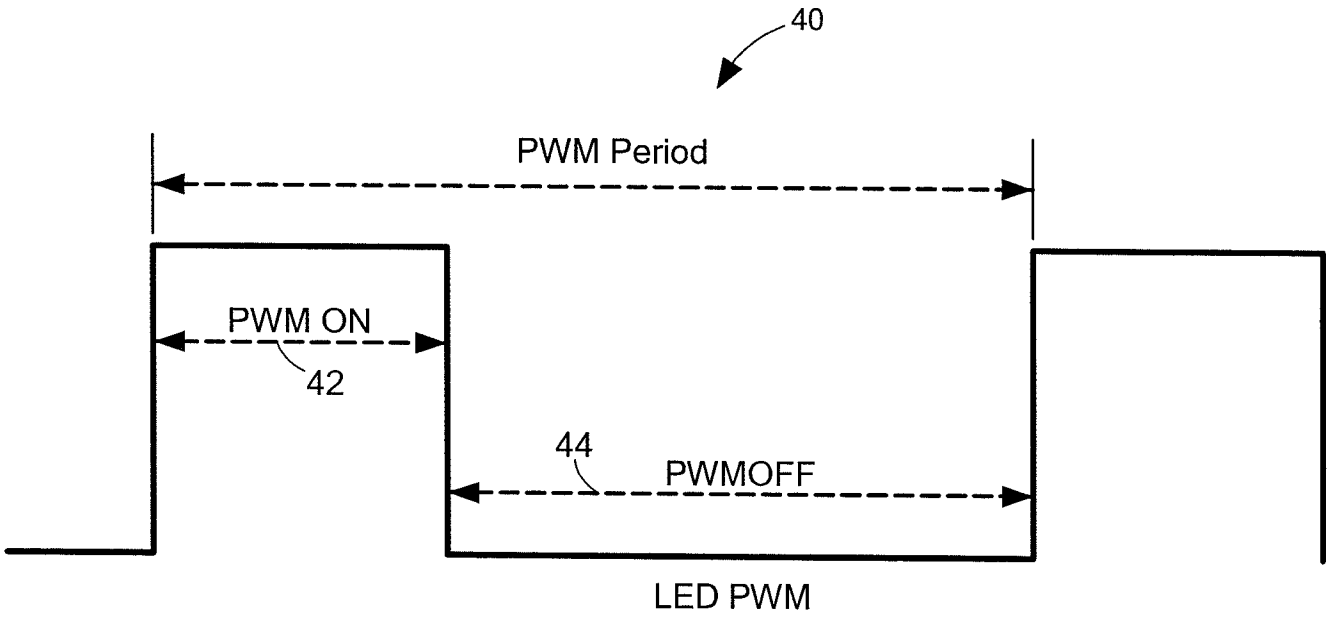
FIG. 2 is a diagram showing a pulse width modulation (PWM) waveform that may be used to set a dimming duty cycle of one or more LEDs in accordance with an embodiment.

FIG. 2 is a diagram showing a pulse width modulation (PWM) waveform 40 that may be generated by the dimming control circuitry 20 and used to control the switch 26 of FIG. 1 to set the dimming duty cycle of LED(s) 16. As illustrated, the PWM signal 40 includes an "on" portion 42 and an "off" portion 44. During the "on" portion 42, current will be allowed to flow through the LED(s) 16. During the "off" portion 44, current will be blocked. The illumination intensity of the LED(s) 16 will depend on the relative durations of the on and off periods 42, 44. These portions will repeat in substantially the same form as long as the dimming duty cycle remains constant. If the dimming duty cycle is changed, the relative durations of these signal portions will change accordingly.

In conventional drivers, the regulated voltage associated with the LED(s) 16 (e.g., the voltage across the current sink 24, etc.) would be kept constant throughout driver operation. Typically, a single voltage level would be selected (e.g., the regulation voltage, etc.), and this value would not change. In developing the techniques and systems described herein, it was found that, while a particular regulated voltage level may be acceptable during high dimming duty cycles, the same voltage level may result in a compromised ability to accurately set LED current levels when lower dimming duty cycles are used. In this regard, in one aspect of the features described herein, the regulated voltage level that is used in an LED driver is varied during driver operation based on dimming duty cycle. Thus during higher dimming duty cycles, lower regulated voltage levels may be used by a driver and, during lower dimming duty cycles, higher regulated voltage levels may be used. The higher regulated voltage levels may ensure that an adequate voltage level exists on a current sink during low dimming duty cycle operation to enable accurate current tracking.

Figure 3:
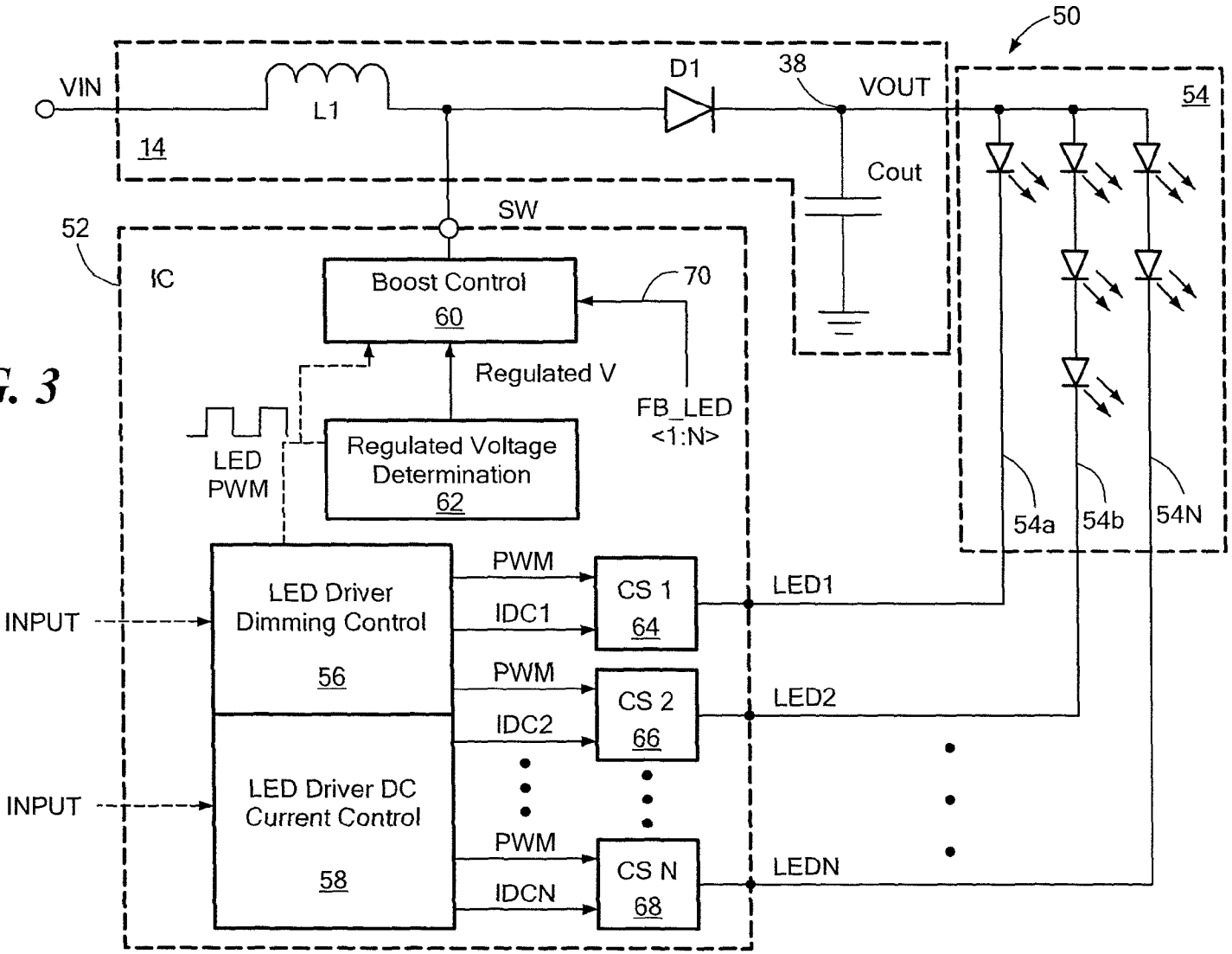
FIG. 3 is a schematic diagram illustrating an exemplary LED driver system using a variable regulated voltage value in accordance with an embodiment.

FIG. 3 is a schematic diagram illustrating an exemplary LED driver system 50 in accordance with an embodiment. As illustrated, the LED driver system 50 may include LED driver circuitry 52 and a boost converter 14. A plurality of LEDs 54 to be driven are coupled to an output of the LED driver system 50. As shown, the LEDs 54 may be arranged in a number of series-connected strings (or LED "channels) 54*a*, 54*b*, 54*n* that are each coupled to a common voltage node 38 at the output of the boost converter 14. Other arrangements may also be used. The LED driver circuitry 52 includes boost control circuitry 60, LED driver dimming control circuitry 56, LED driver DC current control circuitry 58, and a plurality of current sinks 64, 66, 68, with one current sink corresponding to each of the LED channels 54*a*, 54*b*, 54*n*. The LED driver circuitry 52 also includes regulated voltage determination circuitry 62 to determine a regulated voltage value to be used for the LEDs 54 based on dimming duty cycle.

As described previously, the LED driver dimming control circuitry 56 and the LED driver DC current control circuitry 58 may provide control signals to each of the current sinks 64, 66, 68 to control the dimming and DC current, respectively, of the corresponding LED channels. In some multi-channel embodiments, the LED driver circuitry 52 may use the same dimming duty cycle for all of the LED channels 54*a*, 54*b*, 54*n*. In other multi-channel embodiments, the LED driver circuitry 52 may allow different dimming duty cycles to be used in different channels. The LED driver dimming control circuitry 56 and the LED driver DC current control circuitry 58 may each include an input to receive control signals from one or more external controllers that are indicative of desired dimming and current values. The LED driver dimming control circuitry 56 and the LED driver DC current control circuitry 58 may also, in some implementations, be user configurable/programmable to allow a user to set desired dimming and/or current values. One or more data storage locations may be provided within the LED driver circuitry 52 to store user-provided configuration information to set operational parameters such as, for example, dimming duty cycle and LED current level. Default values may be used for the different parameters in the absence of user provided values.

In some implementations, the LED driver dimming control circuitry 56 and the LED driver DC current control circuitry 58 may allow one or more of the LED channels 54*a*, 54*b*, 54*n* to be temporarily disabled by a user. These channels will not illuminate until they are eventually re-enabled. The LED driver dimming control circuitry 56 and the LED driver DC current control circuitry 58 may be implemented using digital, analog, or a combination of digital and analog circuitry.

Although LED driver system 50 is depicted with a boost converter 14 and boost control circuitry 60 in FIG. 3, it should be appreciated that other types of DC-DC converters and converter controllers may be used in other implementations. In addition, although illustrated with current sinks 64, 66, 68 coupled to the lower ends of the LED channels 54*a*, 54*b*, 54*n* in FIG. 3, it should be appreciated that other current regulation device types/positions may be used in other implementations (e.g., current sources at the top of the LED channels 54*a*, 54*b*, 54*n*, etc.).

In some embodiments, different LED channels being driven by an LED driver system may be allowed to have different numbers of LEDs. For example, as shown in FIG. 3, LED channel 54*a* may include one LED, LED channel 54*b* may include three LEDs, LED channel 54*n* may include two LEDs, and so on. In general, the voltage that appears across the current sink associated with a particular LED channel will be equal to the output voltage of the boost converter ($V_{OUT}$) reduced by the voltage drop across the LEDs of the channel. For this reason, the LED channel having the highest number of LEDs will typically have the lowest voltage across its current sink and will thus require the highest boost output voltage to support reliable, accurate operation. If multiple (or all) LED channels have the same "highest number" of LEDs, then one of these LED channels may still require a higher boost voltage than the others due to, for example, variations in individual LED characteristics due to manufacturing tolerances. In some implementations, one or more ballast resistors (not shown) may be included in LED channels having fewer LEDs to equalize the voltage drops of the channels. This technique may result in more uniform voltage levels across the LED pins of the LED driver circuitry 52. As used herein, the terms "dominant LED channel" and "dominant channel" will be used to identify the LED channel being driven by an LED driver that requires the highest boost voltage to operate properly.

As described above, the regulated voltage determination circuitry 62 of the LED driver circuitry 52 is operative for determining a regulated voltage value for use in connection with the LEDs 54, based on dimming duty cycle. The regulated voltage value may then be used by the boost control circuitry 60 to regulate a voltage associated with the LEDs 54. The regulated voltage determination circuitry 62 may receive information from the LED driver dimming control circuitry 56 that is indicative of a dimming duty cycle to be used by some or all of the LEDs 54. The regulated voltage determination circuitry 62 may then use this information to determine a regulated voltage value. The regulated voltage value may then be delivered to the boost controller 60. In some embodiments, the information received from the LED driver dimming control circuitry 56 may include, for example, a dimming duty cycle value that may be used to select an appropriate regulated voltage value. In some other embodiments, the regulated voltage determination circuitry 62 may receive a signal from the LED driver dimming control circuitry 56 from which the dimming duty cycle can be extracted. For example, the regulated voltage determination circuitry 62 may receive a pulse width modulation (PWM) control signal from the LED driver dimming control circuitry 56 that is associated with one or more LED channels 54*a*, 54*b*, 54*n* (e.g., a signal that is used to control one or more of the current sinks 64, 66, 68, etc.). In these embodiments, the regulated voltage determination circuitry 62 may be configured to extract the dimming duty cycle value from the received signal and then use the extracted value to determine the regulated voltage value. In other embodiments, other types of dimming duty cycle related information may be provided to the regulated voltage determination circuitry 62 from the LED driver dimming control circuitry 56.

As described above, the regulated voltage determination circuitry 62 may deliver the regulated voltage value it determines to the boost control circuitry 60. As shown in FIG. 3, the boost control circuitry 60 may also receive feedback 70 from the LEDs 54. In the illustrated embodiment, the feedback includes the voltages (FB_LED<1:N>) on the various LED pins of the LED driver circuitry 52 (i.e., the voltages across the current sinks 64, 66, 68), but other sources of feedback are also possible. The boost control circuitry 60 may be configured to use the feedback 70 and the regulated voltage value to generate a control signal for the boost converter 14 in a manner that regulates a voltage associated with the LEDs 54.

As described above, in some embodiments, the same dimming duty cycle may be used for all of the LED channels 54*a*, 54*b*, 54*n* coupled to LED driver circuitry 52. In these embodiments, a single regulated voltage determination circuit 62 may be provided. In other embodiments, LED driver circuitry 52 may be capable of setting a different dimming duty cycle for each of the LED channels 54*a*, 54*b*, 54*n*. In these embodiments, a different regulated voltage determination circuit 62 may be provided for each LED channel 54*a*, 54*b*, 54*n*. A maximum selector circuit (not shown) may then be used to select the highest regulated voltage value from amongst the values generated by the different regulated voltage determination circuits 62 for delivery to the boost controller 60. In an alternative approach, a minimum selector circuit may be provided to select a lowest dimming duty cycle from amongst the different LED channels. The lowest dimming duty cycle may then be used to generate a corresponding regulated voltage level for the boost control unit 60.

Figure 4A:
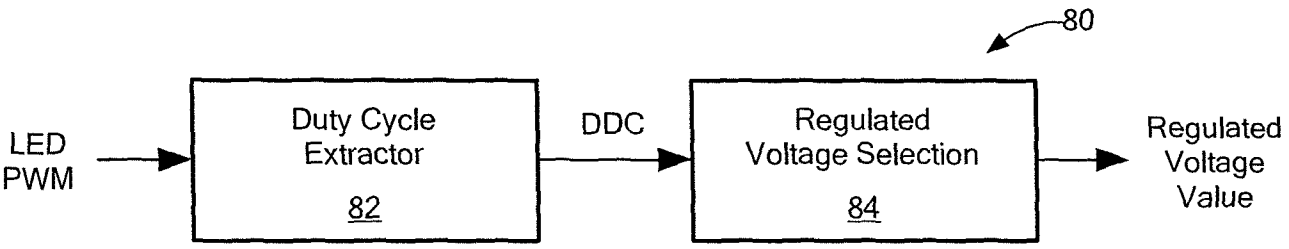
FIG. 4*a* is a block diagram illustrating an exemplary regulated voltage determination circuit in accordance with an embodiment.

FIG. 4*a* is a block diagram illustrating exemplary regulated voltage determination circuitry 80 in accordance with an embodiment. The regulated voltage determination circuitry 80 of FIG. 4*a* may be used within, for example, the LED driver system 10 of FIG. 1, the LED driver system 50 of FIG. 3, or in other LED driver systems. As shown, the regulated voltage determination circuitry 80 includes a duty cycle extractor 82 and a regulated voltage value selection unit 84. These components may be implemented using analog circuitry, digital circuitry, or a combination of analog and digital circuitry. The duty cycle extractor 82 receives a PWM signal at an input thereof that is associated with driven LEDs. The duty cycle extractor 82 then processes the PWM signal to extract a dimming duty cycle from the signal. The dimming duty cycle is then forwarded to the regulated voltage value selection unit 84 which determines a regulated voltage value based on the dimming duty cycle. The regulated voltage selection unit 84 may generate the regulated voltage value in any of a variety of different ways in different implementations. For example, in one approach, the regulated voltage selection unit 84 may evaluate an equation (that is a function of dimming duty cycle) to determine the regulated voltage value. In another approach, the regulated voltage selection unit 84 may use a lookup table (LUT) to determine a regulated voltage value. In still another approach, analog circuitry may be used to generate the value (e.g., filter circuitry, etc.). Other techniques may alternatively be used. In some embodiments, a dimming duty cycle value may already be available for use in determining the regulated voltage value and, therefore, the duty cycle extractor 82 is not needed.

Figure 4B:
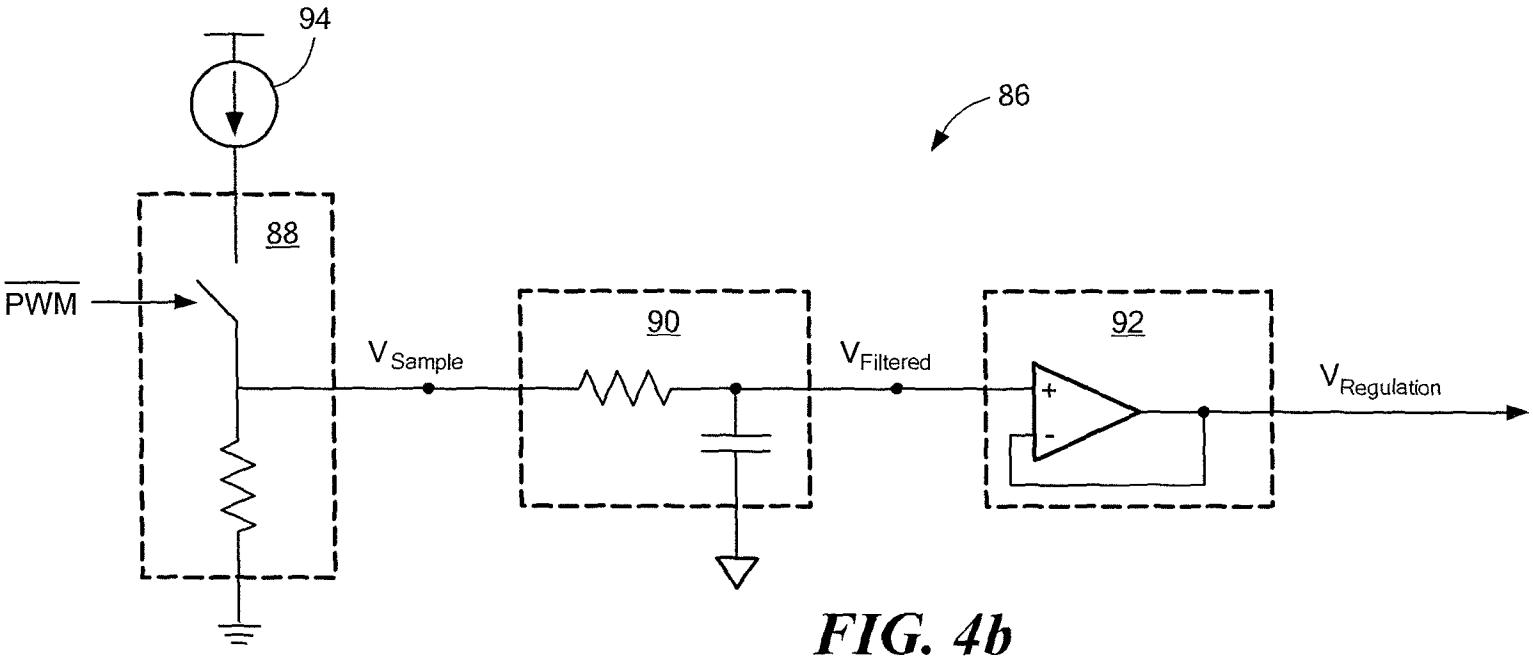
FIG. 4*b* is a schematic diagram illustrating an exemplary analog regulated voltage determination circuit in accordance with an embodiment.
Figure 4C:
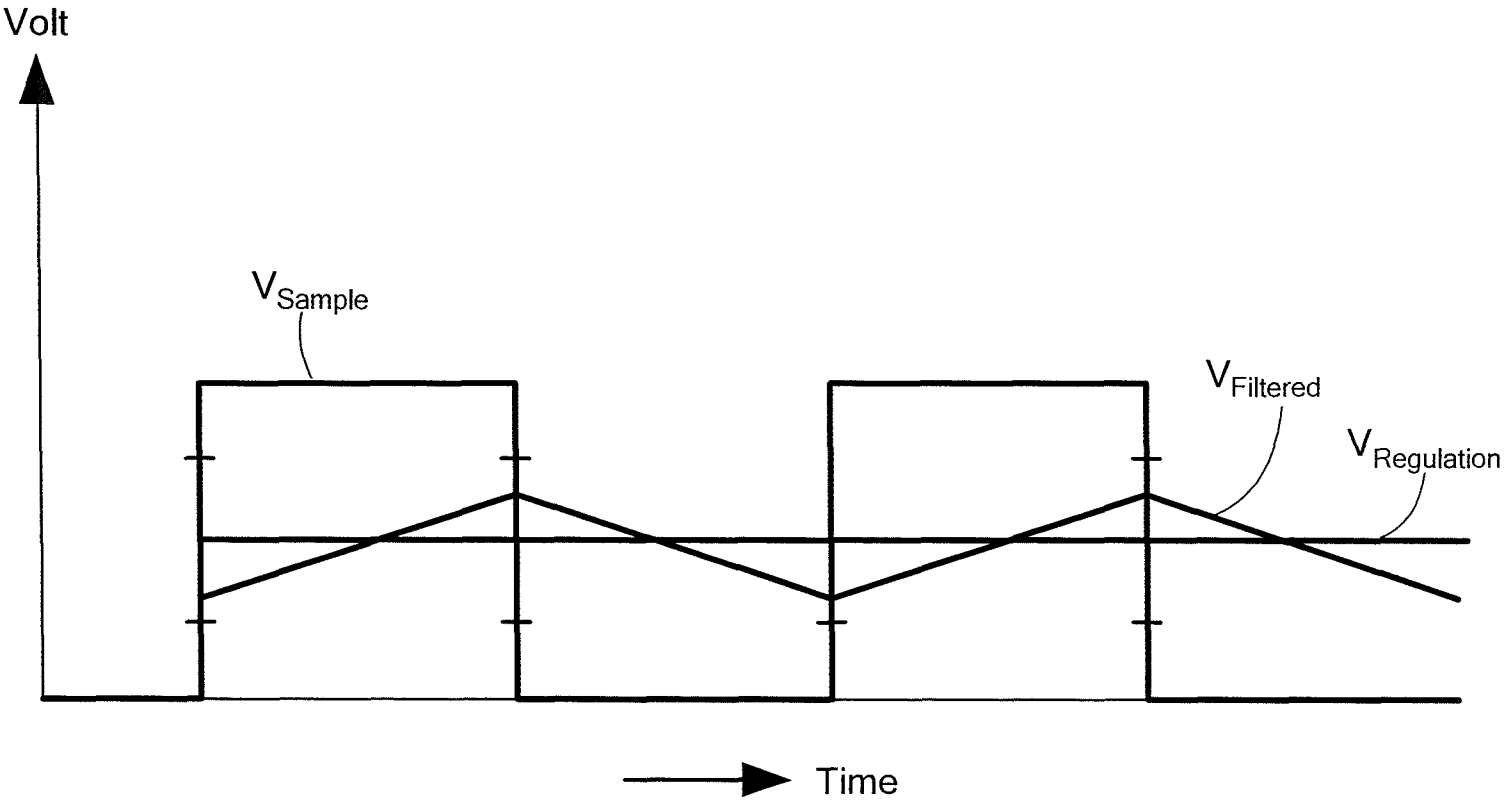
FIG. 4*c* is a timing diagram illustrating signals associated with the analog regulated voltage determination circuit of FIG. 4*b;*

FIG. 4*b* is a schematic diagram illustrating an exemplary analog regulated voltage determination circuit 86 in accordance with an embodiment. FIG. 4*c* is a timing diagram illustrating various signals at points within the analog regulated voltage determination circuit 86 of FIG. 4*b*. As shown, the regulated voltage determination circuit 86 may include: a duty cycle extractor 88, a low pass filter 90, and a low bandwidth unity gain buffer 92. The duty cycle extractor 88 may include a switch coupled to ground through a resistance. A current source 94 may be coupled to an opposite side of the switch to provide a current through the resistance when the switch is closed. The switch may be controlled using the PWM signal of interest (or an inverted version thereof, as in the illustrated embodiment). The output of the duty cycle extractor 88 is shown in FIG. 4*c* as $V_{sample}$. The low pass filter 90 is operative for suppressing higher frequency components within $V_{sample}$ to generate a filtered signal $V_{filtered}$ (see FIG. 4*c*). The filtered signal is then processed within the low bandwidth unity gain buffer 92 to generate the regulated voltage signal $V_{regulation}$ (see FIG. 4*c*). Other techniques and circuits for generating the regulated voltage value may alternatively be used.

Figure 5:
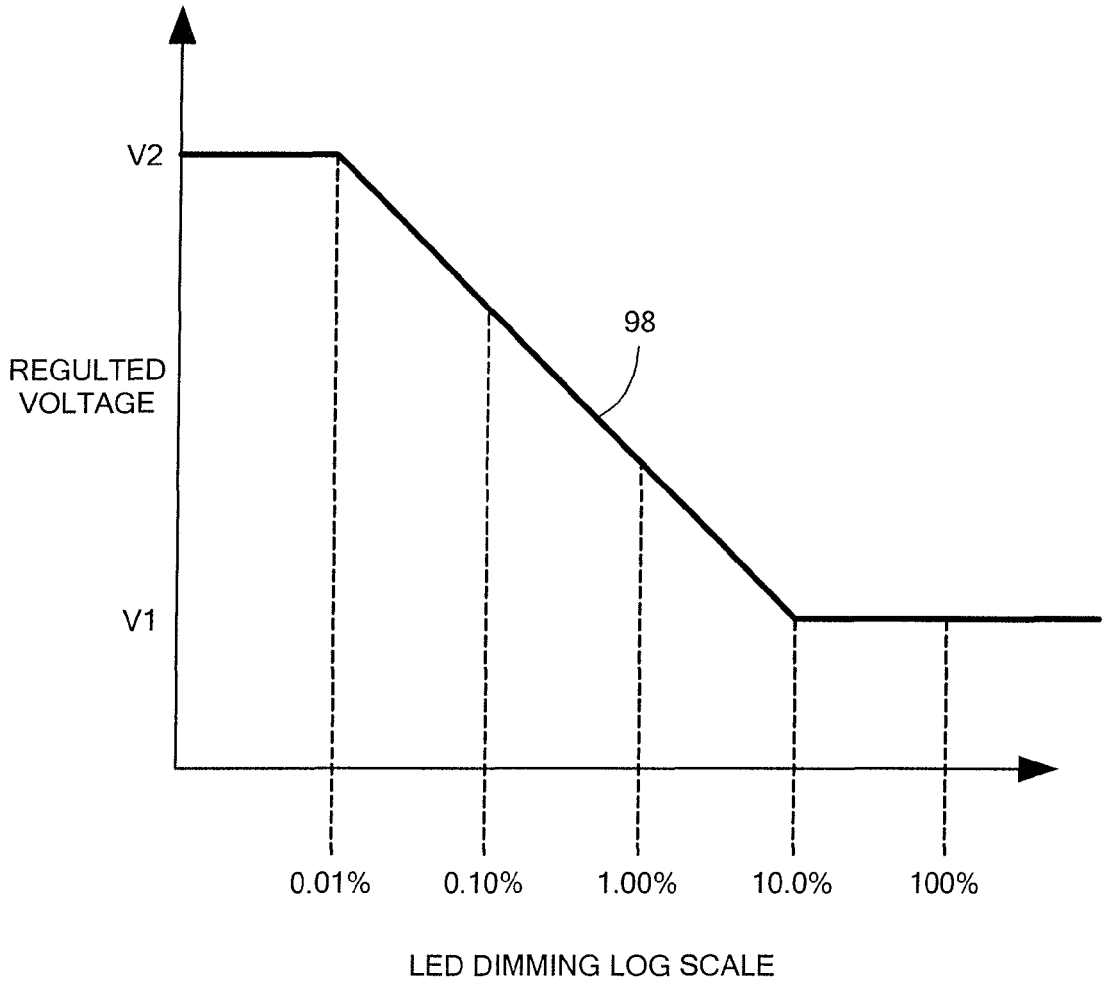
FIG. 5 is a graph illustrating an exemplary regulated voltage versus dimming duty cycle function that may be used to determine a regulated voltage value for use in an LED driver accordance with an embodiment.

FIG. 5 is a graph illustrating an exemplary regulated voltage versus dimming duty cycle function 98 that may be used to determine a regulated voltage value for use in an LED driver in accordance with an embodiment. The function 98 may be implemented within, for example, the regulated voltage determination unit 62 of FIG. 3 in some embodiments. As shown, the function 98 decreases monotonically within increasing dimming duty cycle. As depicted, the function 98 returns a first fixed regulated voltage value for dimming duty cycles above a first threshold level (e.g., a voltage of V1 for dimming duty cycles above 10 percent in the illustrated embodiment). This first regulated voltage value may be selected to achieve, for example, an enhanced operational efficiency within the driver. The first regulated voltage value may include, for example, the regulation voltage (LEDx) that would traditionally have been used for all dimming duty cycles. The first threshold level may be selected as a dimming value above which there is little or no known current accuracy degradation in the LED driver circuit. In some implementations, a first threshold value between 5 percent and 20 percent may be used.

The function 98 returns a second fixed regulated voltage value for dimming duty cycles that are below a second threshold level (e.g., a voltage of V2 for dimming duty cycles below 0.01 percent in the illustrated embodiment). The second fixed regulated voltage value may be selected to achieve enhanced current accuracy within the LED channels for very low dimming duty cycles. The function 98 returns a variable regulated voltage value for dimming duty cycles between the first and second threshold levels. As depicted, the variable regulated voltage value varies along a straight line when plotted on a logarithmic duty cycle scale. In this manner, a progressively smaller regulated voltage value may be used as dimming duty cycle increases.

It should be appreciated that the function 98 of FIG. 5 is merely one example of a voltage function that may be used in accordance with an embodiment. Other functions may alternatively be used. For example, in some embodiments, a function may be used that switches between two or more fixed regulated voltage values with no intermediate variable portions. Thus, in one embodiment, a function may be used that returns one regulated voltage value for dimming duty cycles above a threshold value and another regulated voltage value for dimming duty cycles below the threshold value. In another approach, the dimming duty cycle range may be separated into three or more different sub-ranges, with each sub-range having a corresponding regulated voltage value. Other techniques are also possible. In each case, the function should provide a regulated voltage value that decreases monotonically with increasing dimming duty cycle (although minor variations from a strict monotonic decrease may be used in some implementations). As described previously, the function that is ultimately used may be realized in any of a number of ways within a corresponding systems (e.g., as an equation, using an LUT, etc.).

Figure 6:
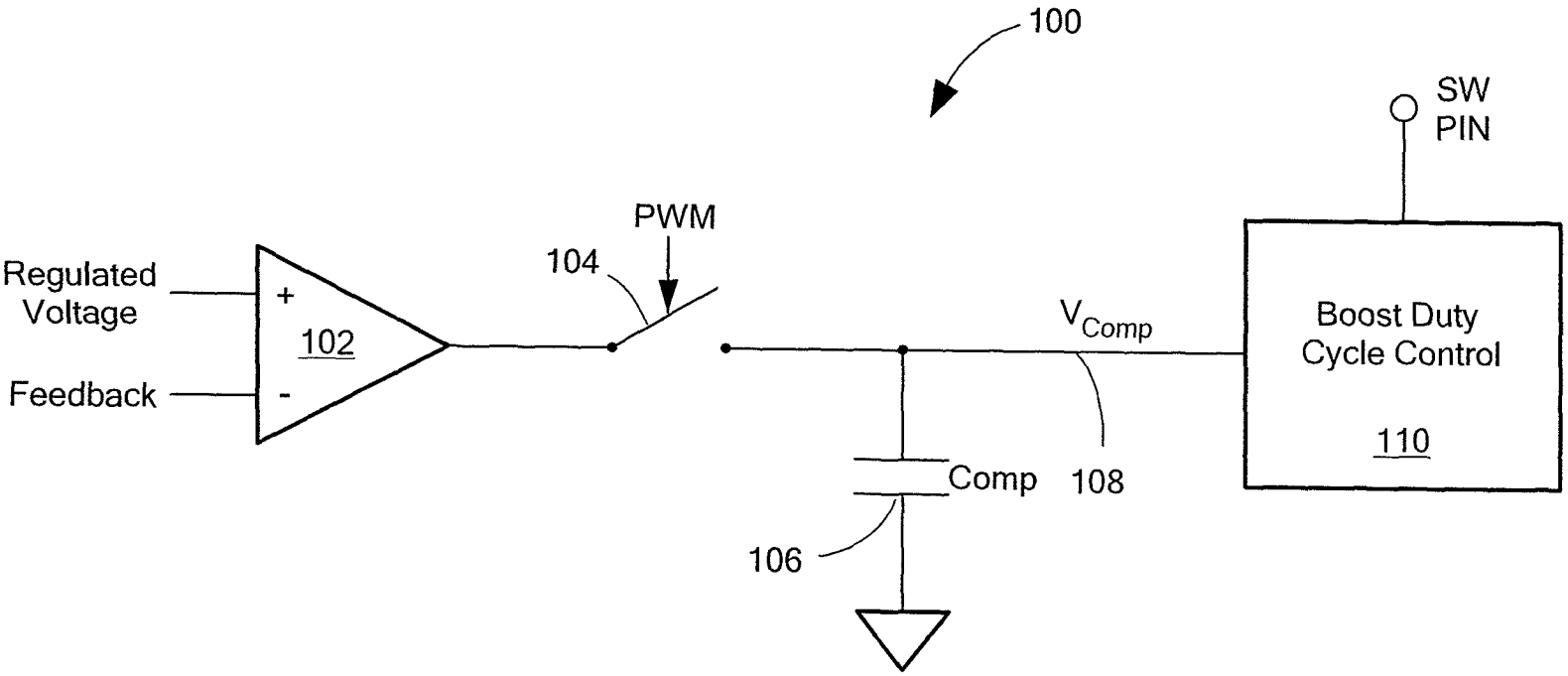
FIG. 6 is a schematic diagram illustrating exemplary boost control circuitry accordance with an embodiment.

FIG. 6 is a schematic diagram illustrating exemplary boost control circuitry 100 in accordance with an embodiment. The boost control circuitry 100 may be used within, for example, the LED driver system 10 of FIG. 1, the LED driver system 50 of FIG. 3, or in other LED driver systems. As shown, the boost control circuitry 100 may include: an error amplifier 102, a switch 104, a COMP capacitor 106, and a boost duty cycle control unit 110. The error amplifier 102 may receive a regulated voltage value generated by a regulated voltage determination unit at a first input and feedback from a plurality of driven LEDs at one or more second inputs. The error amplifier 102 may then use this input information to generate an error signal at an output thereof. The COMP capacitor 106 is operative for holding a voltage value $V_{comp}$ that is related to a boost duty cycle to be used in a corresponding boost converter (e.g., boost converter 14 of FIG. 3, etc.). The boost duty cycle control unit 110 is operative for generating a switching signal for the corresponding boost converter to operate the converter at the boost duty cycle indicated by $V_{comp}$. In this manner, the duty cycle of the boost converter may be varied in a fashion that tends to reduce or minimize the error between a feedback value and the regulated voltage value.

In different implementations, different LED feedback may be used by the error amplifier 102 to generate the error signal. In some embodiments, for example, the error amplifier 102 may use the voltage across a current sink associated with a dominant LED channel to generate the error voltage. In some other embodiments, the error amplifier 102 may use an average voltage across current sinks associated with all LED channels to generate the error voltage. Other types of feedback may alternatively be used. The feedback that is used to generate the error voltage will determine which voltage associated with the driven LEDs will be regulated to the regulation voltage value.

The switch 104 is operative for controllably coupling the output of the error amplifier 102 to the COMP capacitor 106 during driver operation. As shown, in some implementations, the switch 104 may be controlled using a PWM signal associated with one or more of the driven LEDs. In embodiments where all LEDs are driven at the same dimming duty cycle, the switch 104 may be driven using the PWM signal associated with all of the driven LEDs. The error signal will thus be coupled to the COMP capacitor 106 during the on portion of the dimming duty cycle and decoupled from the COMP capacitor 106 during the off portion of the dimming duty cycle. During the off portion of the dimming duty cycle, the voltage on the COMP capacitor 106 will remain substantially constant so that, when a next on portion occurs, $V_{comp}$ will already be at its previous value. This technique can be used to increase the adaptation speed of the loop. In embodiments where different LED channels are allowed to use different dimming duty cycles, the switch 104 may be controlled using a PWM signal associated with the dominant LED channel. It should be appreciated that the boost control circuitry 100 of FIG. 6 is merely an example on one architecture that may be used in accordance with an embodiment. That is, other alternative architectures may be used in other implementations.

Figure 7:
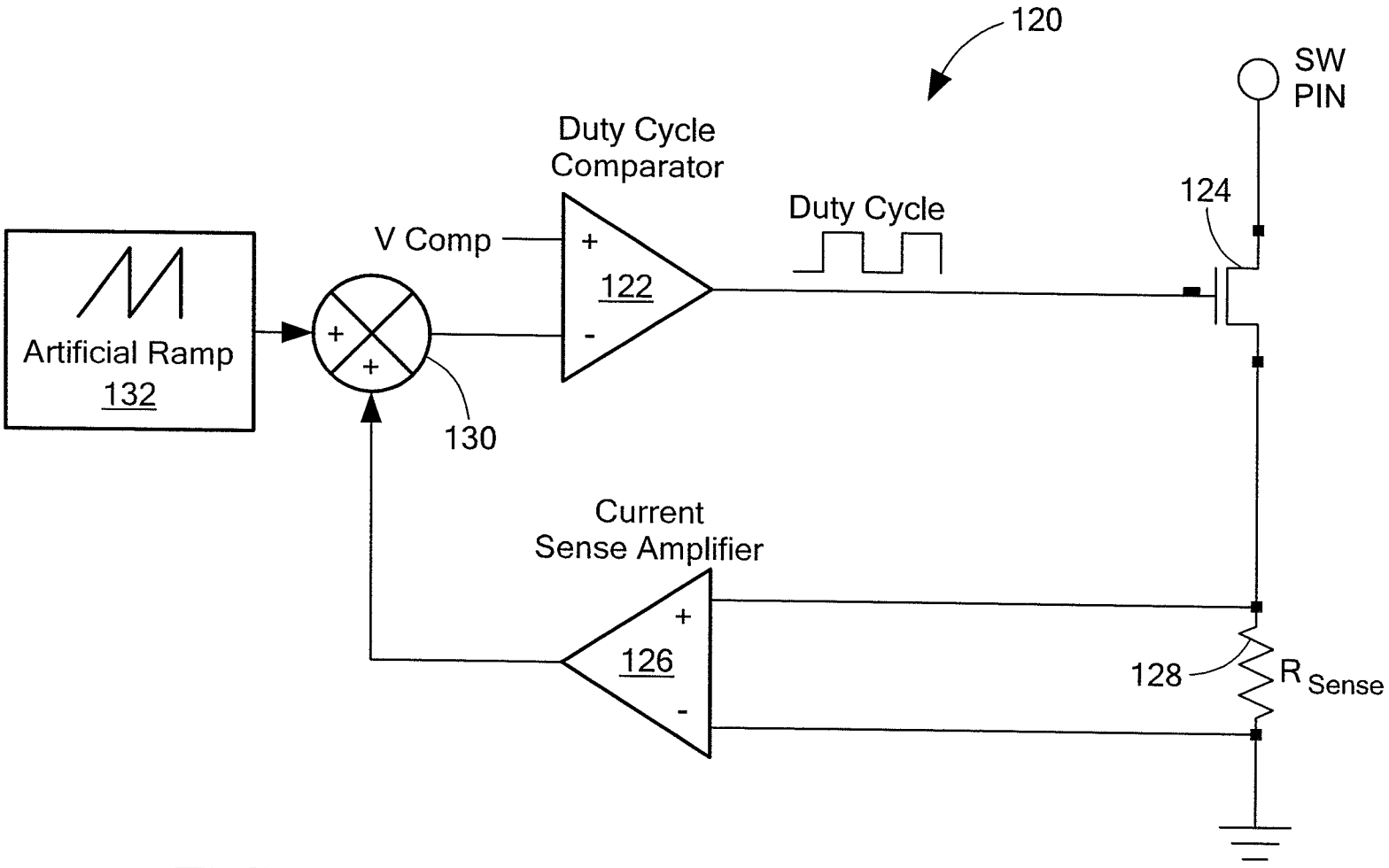
FIG. 7 is a schematic diagram illustrating exemplary duty cycle control circuitry for use in generating a switching control signal for a DC-DC converter in accordance with an embodiment.

FIG. 7 is a schematic diagram illustrating exemplary duty cycle control circuitry 120 for use in generating a switching control signal for a DC-DC converter in accordance with an embodiment. The duty cycle control circuitry 120 may be used within, for example, the boost control circuitry 100 of FIG. 6 or in other DC-DC converter control units. As illustrated, the duty cycle control circuitry 120 includes: a duty cycle comparator 122, a switch 124, a current sense amplifier 126, a sense resistor 128, a combination unit 130, and an artificial ramp generator 132. The switch 124 may be coupled to a switching node associated with a DC-DC converter (e.g., boost converter 14 of FIG. 3, etc.) to generate a switching signal for the converter that sets a duty cycle thereof. The duty cycle comparator 122 is operative for generating an input signal for the switch 124 based on $V_{COMP}$. To generate the input signal, duty cycle comparator 122 may compare $V_{COMP}$ to a ramp signal generated by ramp generator 132. In some embodiments, current sense resistor 128, current sense amplifier 126, and combination unit 130 may be used to modify the ramp signal to compensate for a current level being drawn through switch 128. It should be appreciated that duty cycle control unit 120 of FIG. 7 represents one possible architecture that may be used in an embodiment. Other control architectures may alternatively be used.

As described above, in some embodiments, LED driver circuitry 52 of FIG. 3 may be partially or fully implemented as an IC. In such embodiments, boost control circuitry 60 may be fully implemented on-chip or one or more elements thereof (e.g., a COMP capacitor, etc.) may be implemented off-chip. In addition, it should be understood that the elements of boost control circuitry 60 (and other control units) will not necessarily be located in close proximity to one another within a realized circuit. That is, in some implementations, the elements may be spread out within a larger system and coupled together using appropriate interconnect structures.

Figure 8:
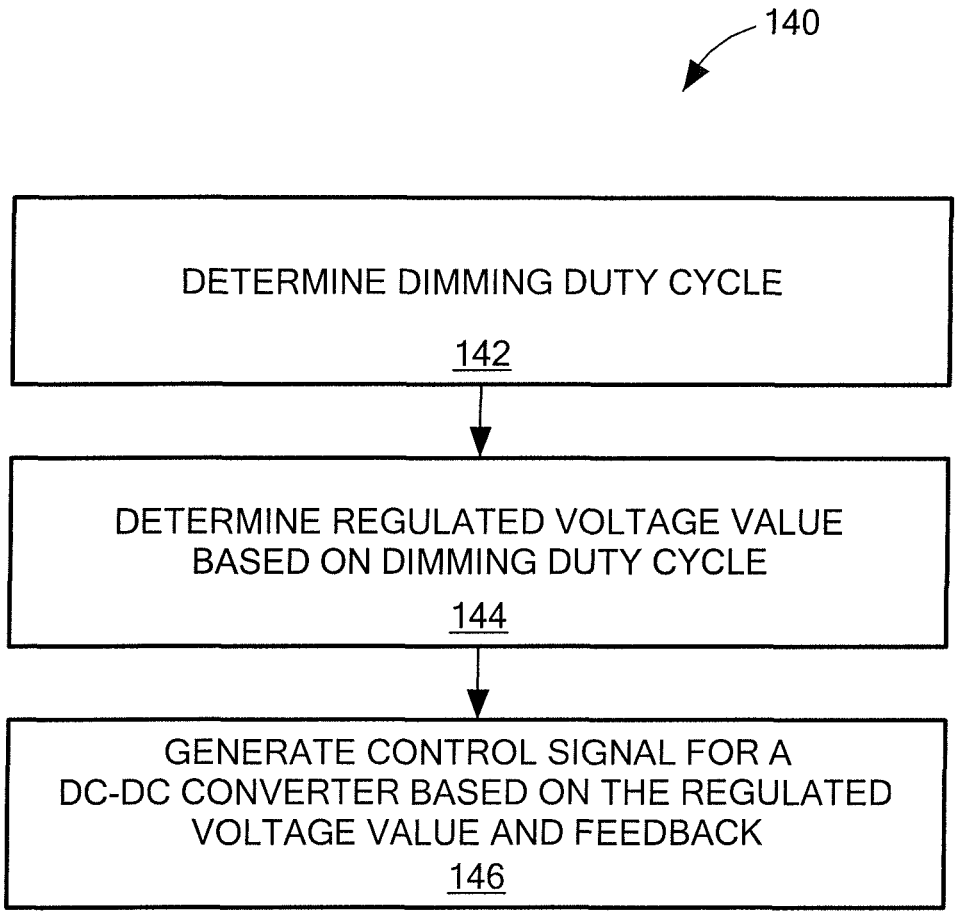
FIG. 8 is a flowchart illustrating a method for use in driving LED loads in accordance with an embodiment.

FIG. 8 is a flow diagram showing a process for driving LED loads in accordance with an embodiment.

The rectangular elements (typified by element 142 in FIG. 8) are herein denoted "processing blocks" and may represent computer software instructions or groups of instructions. It should be noted that the flow diagram of FIG. 8 represents one exemplary embodiment of the design described herein and variations in such a diagram, which generally follow the process outlined, are considered to be within the scope of the concepts, systems, and techniques described and claimed herein.

Alternatively, the processing blocks may represent operations performed by functionally equivalent circuits such as, for example, a digital signal processor circuit, an application specific integrated circuit (ASIC), a field programmable gate array (FPGA), or a circuit formed from discrete elements. Some processing blocks may be manually performed while other processing blocks may be performed by a processor or circuit. The flow diagram of FIG. 8 does not depict the syntax of any particular programming language. Rather, the flow diagram illustrates the functional information one of ordinary skill in the art requires to fabricate circuits and/or to generate computer software to perform the processing required of the particular apparatus. It should be noted that many routine program elements, such as initialization of loops and variables and the use of temporary variables may not be shown. It will be appreciated by those of ordinary skill in the art that unless otherwise indicated herein, the particular sequence described is illustrative only and can be varied without departing from the spirit of the concepts described and/or claimed herein. Thus, unless otherwise stated, the processes are unordered meaning that, when possible, the sequences shown in FIG. 8 can be performed in any convenient or desirable order.

With reference to FIG. 8, a dimming duty cycle associated with a plurality of LEDs may first be determined (block 142). A regulated voltage value may then be selected based, at least in part, on the dimming duty cycle (block 144). In some embodiments, the regulated voltage value may be selected in accordance with a function that decreases monotonically with increasing dimming duty cycle. A control signal may subsequently be generated for a DC-DC converter (e.g., a boost converter, a buck converter, a boost-buck converter, etc.) using the regulated voltage value and feedback from the LED(s) (block 146). The feedback may include voltages corresponding to one or more current regulation devices associated with the LED channels (e.g., a voltage across a current sink associated with a dominant LED channel, etc).

In some implementations, the same dimming duty cycle may be used by all LEDs being driven (e.g., LEDs in all driven channels, etc.). In other implementations, it may be possible to use different dimming duty cycles in different channels. In these implementations, the dimming duty cycle used to generate the regulated voltage value may be the lowest value being used in the corresponding driver system. As described previously, by using a higher regulated voltage value for lower dimming duty cycles, current accuracy can be enhanced for lower dimming duty cycles, while still maintaining high operational efficiency for higher dimming duty cycles.

In the description above, techniques and circuits for driving loads using a DC-DC converter have been discussed in the context of LED driver circuitry. It should be appreciated, however, that these techniques and circuits may also be used in other applications. That is, in some implementations, the described techniques and circuits may be used to drive loads other than LEDs according to a variable duty cycle.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A method for use in driving one or more LED loads, comprising:

regulating a voltage associated with at least one LED load; and varying a regulated voltage value used during regulating based, at least in part, on a present dimming duty cycle associated with the at least one LED load, wherein varying a regulated voltage value includes varying the regulated voltage value according to a function that decreases monotonically with increasing dimming duty cycle.

2. A method for use in driving one or more LED loads, comprising:

regulating a voltage associated with at least one LED load; and varying a regulated voltage value used during regulating based, at least in part, on a present dimming duty cycle associated with the at least one LED load, wherein varying a regulated voltage value comprises using a fixed regulated voltage value if the present dimming duty cycle of the at least one LED load is above a first threshold value and using a variable regulated voltage value that is greater than the fixed regulated voltage value if the present dimming duty cycle of the at least one LED load is below the first threshold value.

3. The method of claim 2, wherein:

the first threshold value corresponds to a dimming duty cycle between 5 percent and 20 percent.

4. A method for use in driving one or more LED loads, comprising:

regulating a voltage associated with at least one LED load; and varying a regulated voltage value used during regulating based, at least in part, on a present dimming duty cycle associated with the at least one LED load, wherein varying a regulated voltage value comprises using a first fixed regulated voltage value if the present dimming duty cycle of the at least one LED load is above a first threshold value and using a second fixed regulated voltage value if the present dimming duty cycle of the at least one LED load is below a second threshold value.

5. The method of claim 4, wherein:

varying a regulated voltage value comprises using a variable regulated voltage value that varies between the first fixed regulated voltage value and the second fixed regulated voltage value if the present dimming duty cycle of the at least one LED load is between the first threshold value and the second threshold value.

6. A method for use in driving one or more LED loads, comprising:

regulating a voltage associated with at least one LED load; and varying a regulated voltage value used during regulating based, at least in part, on a present dimming duty cycle associated with the at least one LED load, wherein the at least one LED load includes an LED channel that is coupled to a current regulation device to regulate a current flowing through the LED channel;

wherein regulating a voltage associated with at least one LED load includes regulating a voltage across the current regulation device; and wherein varying a regulated voltage value used during regulating includes varying the regulated voltage value in a manner that improves LED current accuracy for low dimming duty cycles.

7. A method for use in driving one or more light emitting diodes (LEDs) using a DC-DC converter, the method comprising:

determining a dimming duty cycle for at least one LED;

determining a regulated voltage value to be used in connection with the at least one LED based, at least in part, on the dimming duty cycle; and generating a control signal for the DC-DC converter based on the regulated voltage value and feedback associated with the at least one LED, wherein determining a dimming duty cycle includes extracting the dimming duty cycle from a pulse width modulation (PWM) control signal associated with the at least one LED.

8. The method of claim 7, wherein:

determining a regulated voltage value includes determining a regulated voltage value to appear across a current regulation device associated with the at least one LED.

9. The method of claim 7, further comprising:

continually repeating determining a dimming duty cycle, determining a regulated voltage value, and generating a control signal while driving the one or more light emitting diodes (LEDs).

10. A method for use in driving one or more light emitting diodes (LEDs) using a DC-DC converter, the method comprising:

determining a dimming duty cycle for at least one LED;

determining a regulated voltage value to be used in connection with the at least one LED based, at least in part, on the dimming duty cycle; and generating a control signal for the DC-DC converter based on the regulated voltage value and feedback associated with the at least one LED, wherein the one or more LEDs includes multiple parallel LED channels that are each coupled to a corresponding current regulation device, wherein determining a regulated voltage value includes determining a regulated voltage value to appear across a current regulation device associated with one of the multiple LED channels.

11. The method of claim 10, wherein:

determining a dimming duty cycle includes determining a dimming duty cycle to be used in all of the multiple parallel LED channels that are presently enabled.

12. The method of claim 10, wherein:

determining a regulated voltage value to appear across a current regulation device associated with one of the multiple LED channels includes determining a regulated voltage value to appear across a current regulation device associated with a dominant channel.

13. A method for use in driving one or more light emitting diodes (LEDs) using a DC-DC converter, the method comprising:

determining a dimming duty cycle for at least one LED;

determining a regulated voltage value to be used in connection with the at least one LED based, at least in part, on the dimming duty cycle; and generating a control signal for the DC-DC converter based on the regulated voltage value and feedback associated with the at least one LED, wherein the one or more LEDs includes multiple parallel LED channels that are each coupled to a corresponding current regulation device, wherein determining a regulated voltage value includes determining an average voltage value to appear across the current regulation devices associated with the multiple LED channels.

14. A method for use in driving one or more light emitting diodes (LEDs) using a DC-DC converter, the method comprising:

determining a dimming duty cycle for at least one LED;

determining a regulated voltage value to be used in connection with the at least one LED based, at least in part, on the dimming duty cycle, wherein determining a regulated voltage value includes one or more of:

determining a value in accordance with a function that decreases monotonically with increasing dimming duty cycle;

evaluating an equation;

using a lookup table (LUT);

using a first voltage value if the dimming duty cycle is above a first threshold level and using a variable voltage value that is higher than the first voltage value if the dimming duty cycle is below the first threshold level;

using a first voltage value if the dimming duty cycle is above a first threshold level, using a second voltage value if the dimming duty cycle is below a second threshold level, wherein the second voltage value is greater than the first voltage value, and using a variable voltage value that varies between the first and second voltage values if the dimming duty cycle is between the first and second threshold levels; and generating a control signal for the DC-DC converter based on the regulated voltage value and feedback associated with the at least one LED.

15. The method of claim 14, wherein:

the function is adapted to achieve enhanced operational efficiency for higher dimming duty cycles and enhanced LED current accuracy for lower dimming duty cycles.

16. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the dimming control circuitry is configured to generate a pulse width modulation (PWM) control signal for use with the at least one LED based on the dimming duty cycle; and wherein the regulated voltage determination circuitry includes a duty cycle extractor to receive the PWM control signal and to extract the dimming duty cycle therefrom for use in determining the regulated voltage value.

17. The LED driver circuit of claim 16, wherein:

the regulated voltage determination circuitry is implemented primarily in analog circuitry.

18. The LED driver circuit of claim 16, wherein:

the regulated voltage determination circuitry is implemented primarily in digital circuitry.

19. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the regulated voltage determination circuitry is configured to determine the regulated voltage value in accordance with a function that decreases monotonically with increasing dimming duty cycle.

20. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the regulated voltage determination circuitry is configured to output a fixed regulated voltage value if the dimming duty cycle is above a first threshold value and to output a variable regulated voltage value that is greater than the fixed regulated voltage value if the dimming duty cycle is below the first threshold value.

21. The LED driver circuit of claim 20, wherein:

the first threshold value corresponds to a dimming duty cycle between 5 and 20 percent.

22. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the regulated voltage determination circuitry is configured to output a first fixed regulated voltage value if the dimming duty cycle is above a first threshold value, to output a second fixed regulated voltage value if the dimming duty cycle is below a second threshold value, and to output a variable regulated voltage value that varies between the first fixed regulated voltage value and the second fixed regulated voltage value if the dimming duty cycle is between the first threshold value and the second threshold value.

23. The LED driver circuit of claim 22, wherein:

the regulated voltage determination circuitry includes a lookup table for use in determining a regulated voltage value based on the dimming duty cycle.

24. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the at least one LED includes multiple LEDs arranged in a number of LED channels;

wherein the LED driver circuit includes a current regulation device for each of the LED channels; and wherein the regulated voltage determination circuitry is configured to determine a regulated voltage value to appear across the current regulation device associated with a dominant LED channel.

25. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the LED driver circuit is implemented as an integrated circuit having at least one contact for connection to an external DC-DC converter.

26. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the one or more LEDs includes multiple LEDS arranged in a number of LED channels;

wherein the dimming control circuitry is capable of generating different pulse width modulation (PWM) control signals for use in switching different LED channels in accordance with different dimming duty cycles; and wherein the regulated voltage determination circuitry includes multiple duty cycle extractors to extract dimming duty cycles from different PWM control signals.

27. A light emitting diode (LED) driver circuit to drive one or more LEDs using a DC-DC converter, the LED driver circuit comprising:

dimming control circuitry to set a dimming duty cycle of at least one LED, wherein the dimming control circuitry is capable of changing the dimming duty cycle of the at least one LED over time;

regulated voltage determination circuitry to determine a regulated voltage value to use in connection with the at least one LED based, at least in part, on the dimming duty cycle; and a DC-DC converter controller to generate a control signal for the DC-DC converter based on the regulated voltage value and feedback associated with the at least one LED, wherein the LED driver circuit is capable of driving multiple LEDs at variable load current and over a wide dimming range while generating little or no audible noise.

* * * * *